US010718179B2

(12) United States Patent
Stair et al.

(10) Patent No.: US 10,718,179 B2
(45) Date of Patent: Jul. 21, 2020

(54) WELLBORE ISOLATION DEVICES AND METHODS OF USE

(71) Applicant: Halliburton Energy Services, Inc., Houston, TX (US)

(72) Inventors: Todd Anthony Stair, Norman, OK (US); Gary Joe Makowiecki, Spring, TX (US); Michael Dale Ezell, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 52 days.

(21) Appl. No.: 15/547,783

(22) PCT Filed: Mar. 19, 2015

(86) PCT No.: PCT/US2015/021459
§ 371 (c)(1),
(2) Date: Jul. 31, 2017

(87) PCT Pub. No.: WO2016/148719
PCT Pub. Date: Sep. 22, 2016

(65) Prior Publication Data

US 2018/0023367 A1 Jan. 25, 2018

(51) Int. Cl.

| | |
|---|---|
| ***E21B 33/128*** | (2006.01) |
| ***E21B 33/12*** | (2006.01) |
| *E21B 34/06* | (2006.01) |
| *E21B 34/10* | (2006.01) |
| *E21B 34/00* | (2006.01) |

(52) U.S. Cl.
CPC ..... *E21B 33/1285* (2013.01); *E21B 33/1216* (2013.01); *E21B 34/063* (2013.01); *E21B 34/10* (2013.01); *E21B 2034/007* (2013.01)

(58) Field of Classification Search
CPC ..... E21B 33/1216; E21B 33/1285
USPC ..... 166/387, 118
See application file for complete search history.

(56) References Cited

U.S. PATENT DOCUMENTS

| | | | |
|---|---|---|---|
| 6,053,246 | A | 4/2000 | Echols et al. |
| 6,203,020 | B1 | 3/2001 | Mireles, Jr. et al. |
| 8,616,276 | B2 | 12/2013 | Tips et al. |

(Continued)

FOREIGN PATENT DOCUMENTS

| | | | |
|---|---|---|---|
| WO | 2011028558 | A2 | 3/2011 |
| WO | 2012045168 | A1 | 4/2012 |

OTHER PUBLICATIONS

International Search Report and Written Opinion for PCT/US2015/021459 dated Dec. 2, 2015.

(Continued)

*Primary Examiner* — Taras P Bemko
(74) *Attorney, Agent, or Firm* — Gilliam IP PLLC

(57) ABSTRACT

A packer assembly includes an elongate body, at least one sealing element disposed about the elongate body, and a shoulder disposed about the elongate body and positioned axially adjacent the at least one sealing element. A cover sleeve is coupled to an outer surface of the shoulder. An annular support shoe has a jogged leg, a lever arm, and a fulcrum section that extends between and connects the jogged leg to the lever arm. The jogged leg is received within a gap defined between the cover sleeve and the shoulder, and the lever arm extends axially over a portion of the sealing element.

20 Claims, 9 Drawing Sheets

(56) References Cited

U.S. PATENT DOCUMENTS

| | | | |
|---|---|---|---|
| 8,646,537 | B2 | 2/2014 | Tips et al. |
| 8,708,056 | B2 | 4/2014 | Helms et al. |
| 2003/0079887 | A1 | 5/2003 | Lloyd |
| 2007/0114043 | A1 | 5/2007 | Richards et al. |
| 2007/0246227 | A1 | 10/2007 | Ezell et al. |
| 2011/0174493 | A1 | 7/2011 | Clem |
| 2013/0180732 | A1 | 7/2013 | Acosta et al. |
| 2014/0116732 | A1 | 5/2014 | Acosta et al. |
| 2014/0216762 | A1 | 8/2014 | Acosta et al. |
| 2016/0290093 | A1* | 10/2016 | Doane ..... E21B 33/128 |

OTHER PUBLICATIONS

International Search Report and Written Opinion for PCT/US2015/021479 dated Dec. 2, 2015.

International Search Report and Written Opinion for PCT/US2015/021505 dated Dec. 2, 2015.

U.S. Appl. No. 15/542,920, Non-Final Rejection, dated Jul. 12, 2018, 8 pages.

U.S. Appl. No. 15/542,920, Response to Non-Final Office Action, filed Dec. 10, 2018, 10 pages.

U.S. Appl. No. 15/548,410, Final Rejection, dated Jun. 3, 2019, 15 pages.

U.S. Appl. No. 15/548,410, Non-Final Rejection, dated Jan. 25, 2019, 13 pages.

U.S. Appl. No. 15/548,410, Non-Final Rejection, dated Aug. 2, 2019, 14 pages.

Australian Application Serial No. 2015387217; First Examination Report; dated Feb. 21, 2018, 3 pages.

Canadian Application Serial No. 2,974,332; Office Action; dated Jun. 21, 2018, 3 pages.

Canadian Application Serial No. 2,974,633; Office Action; dated Jun. 13, 2018, 3 pages.

Canadian Application Serial No. 2,976,196; Office Action; dated Jul. 5, 2018, 3 pages.

* cited by examiner

WELLBORE ISOLATION DEVICES AND METHODS OF USE

BACKGROUND

A variety of downhole tools may be used within a wellbore in connection with producing or reworking a hydrocarbon bearing subterranean formation. Some downhole tools include wellbore isolation devices that are capable of fluidly sealing axially adjacent sections of the wellbore from one another and maintaining differential pressure between the two sections. Wellbore isolation devices may be actuated to directly contact the wellbore wall, a casing string secured within the wellbore, or a screen or wire mesh positioned within the wellbore.

Typically, a wellbore isolation device will be introduced and/or withdrawn from the well as attached to a conveyance, such as a tubular string, wireline, or slickline, and actuated to help facilitate certain completion and/or workover operations. In some applications, the wellbore isolation device may be pumped into the well, and thereby allowing hydraulic forces to propel the device in or out of the wellbore.

Typical wellbore isolation devices include a body and a sealing element disposed about the body. The wellbore isolation device may be actuated by hydraulic, mechanical, or electric means to cause the sealing element to expand radially outward and into sealing engagement with the inner wall of the wellbore wall, a casing string, or a screen or wire mesh. In such a "set" position, the sealing element substantially prevents migration of fluids across the wellbore isolation device, and thereby fluidly isolates the axially adjacent sections of the wellbore.

It is often desirable to run downhole tools into and out of the well as quickly as possible to reduce required labor time and other operational costs. Due to the effects of "swabbing," however, wellbore isolation devices are limited in how fast they can be run downhole. Swabbing is a phenomenon where the sealing element inadvertently presets due to flow conditions around the wellbore isolation device. More particularly, when wellbore fluids flow around the sealing element during run-in, the high velocity fluid flow can generate a pressure drop that urges the sealing element radially outward and into engagement with the wellbore wall (or a casing string). When such engagement occurs, further movement of the wellbore isolation device within the wellbore carries or "swabs" fluid with it, which can cause the wellbore isolation device to prematurely actuate and/or otherwise damage or destroy the sealing element. As a result, the run-in speed of a wellbore isolation device is generally limited to slow speeds.

Swabbing can also occur when displacing fluids or flowing fluids around the wellbore isolation device while it is suspended in the wellbore and prior to "setting" the sealing element. Swabbing while displacing fluids can cause the sealing element to prematurely actuate. As a result, the volume of fluid being displaced, or the rate of displacement, will be generally limited.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to downhole tools used in the oil and gas industry and, more particularly, to wellbore isolation devices that incorporate novel designs and configurations of upper and lower support shoes and a spacer that operate to separate and secure upper and lower sealing elements and help mitigate swabbing while running the wellbore isolation devices downhole.

The embodiments described herein provide wellbore isolation devices that may be used to fluidly isolate axially adjacent portions of a wellbore. The designs and configurations of the wellbore isolation devices described herein present less risk of swabbing or prematurely setting sealing elements, and allow faster run-in speeds into a wellbore at higher circulation rates. As will be appreciated, this enables less rig time in getting the wellbore isolation device to total depth. In particular, the wellbore isolation devices described herein employ a spacer with an inverse airfoil design that mitigates swabbing by creating a low-pressure, high velocity zone that helps to divert fluid flow away from the outer surfaces of the sealing elements and, in particular, the sealing element downstream from the fluid flow. The wellbore isolation devices may also employ one or more novel support shoes that include a lever arm that extends axially over the sealing element to provide axial and radial support to an adjacent sealing element. The support shoes may also include a jogged leg sized to fit within a gap that extends from an extrusion gap, and the jogged leg may be configured to plastically deform and generate a seal with in the gap to prevent an adjacent sealing element from creeping into the extrusion gap.

Figure 1:
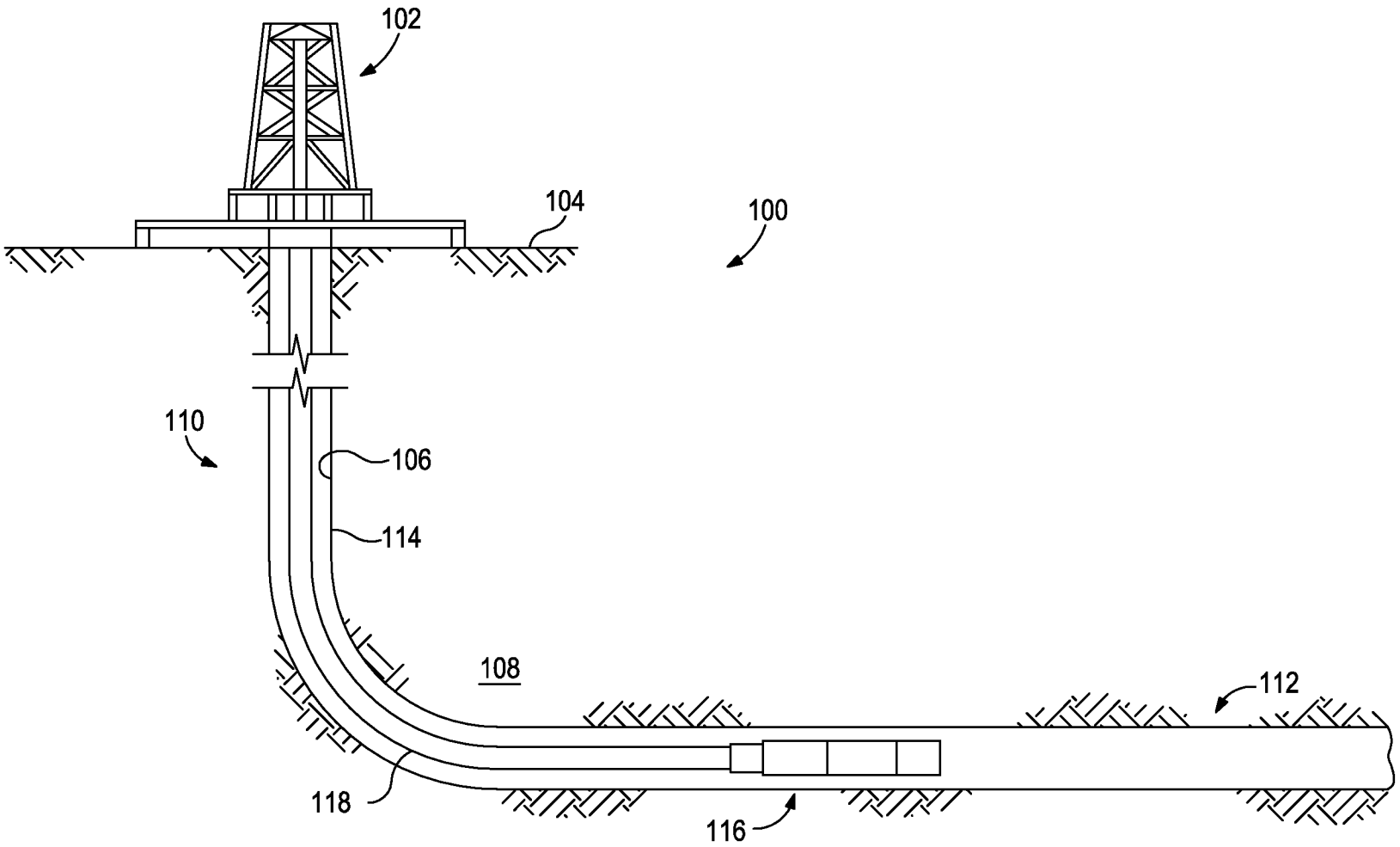
FIG. 1 is a schematic diagram of a well system that may employ one or more principles of the present disclosure.

Referring to FIG. 1, illustrated is a well system 100 that may embody or otherwise employ one or more principles of the present disclosure, according to one or more embodiments. As illustrated, the well system 100 may include a service rig 102 that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation, without departing from the scope of the disclosure. Moreover, while the well system 100 is depicted as a land-based operation, it will be appreciated that the principles of the present disclosure could equally be applied in any sea-based or sub-sea application where the service rig 102 may be a floating platform, a semi-submersible platform, or a sub-surface wellhead installation as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be completed by cementing a casing string 114 within the wellbore 106 along all or a portion thereof. In other embodiments, however, the casing string 114 may be omitted from all or a portion of the wellbore 106 and the principles of the present disclosure may equally apply to an "open-hole" environment.

The system 100 may further include a wellbore isolation device 116 that may be conveyed into the wellbore 106 on a conveyance 118 that extends from the service rig 102. As described in greater detail below, the wellbore isolation device 116 may operate as a type of casing or borehole isolation device, such as a frac plug, a bridge plug, a wellbore packer, a wiper plug, a cement plug, or any combination thereof. The conveyance 118 that delivers the wellbore isolation device 116 downhole may be, but is not limited to, casing, coiled tubing, drill pipe, tubing, wireline, slickline, an electric line, or the like.

The wellbore isolation device 116 may be conveyed downhole to a target location within the wellbore 106. In some embodiments, the wellbore isolation device 116 is pumped to the target location using hydraulic pressure applied from the service rig 102 at the surface 104. In such embodiments, the conveyance 118 serves to maintain control of the wellbore isolation device 116 as it traverses the wellbore 106 and may provide power to actuate and set the wellbore isolation device 116 upon reaching the target location. In other embodiments, the wellbore isolation device 116 freely falls to the target location under the force of gravity to traverse all or part of the wellbore 106. At the target location, the wellbore isolation device may be actuated or "set" to seal the wellbore 106 and otherwise provide a point of fluid isolation within the wellbore 106.

It will be appreciated by those skilled in the art that even though FIG. 1 depicts the wellbore isolation device 116 as being arranged and operating in the horizontal portion 112 of the wellbore 106, the embodiments described herein are equally applicable for use in portions of the wellbore 106 that are vertical, deviated, or otherwise slanted. Moreover, use of directional terms such as above, below, upper, lower, upward, downward, uphole, downhole, and the like are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well.

Figure 2A:
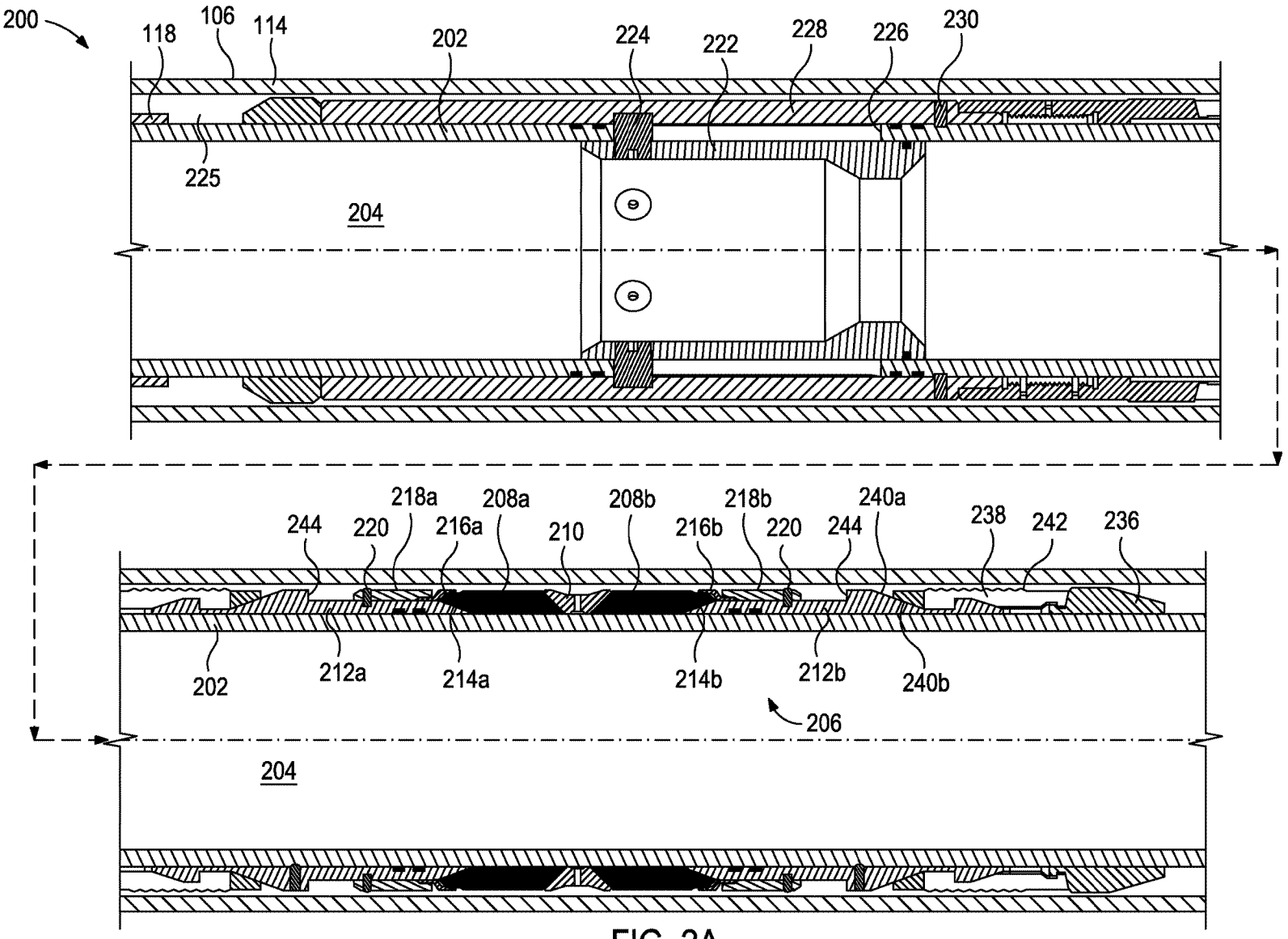
FIGS. 2A-2D depict progressive cross-sectional side views of an exemplary wellbore isolation device.
Figure 2B:
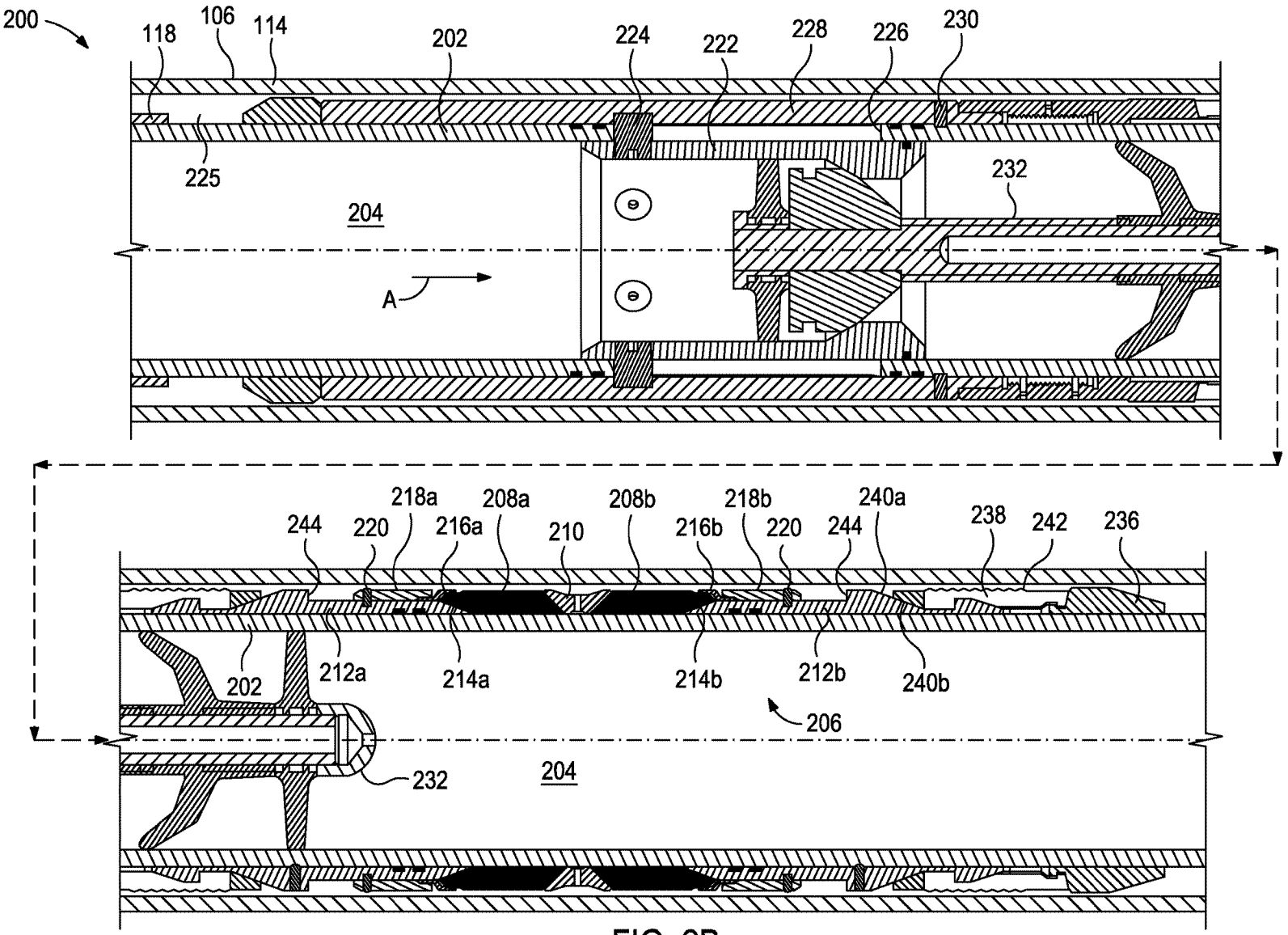
Figure 2C:
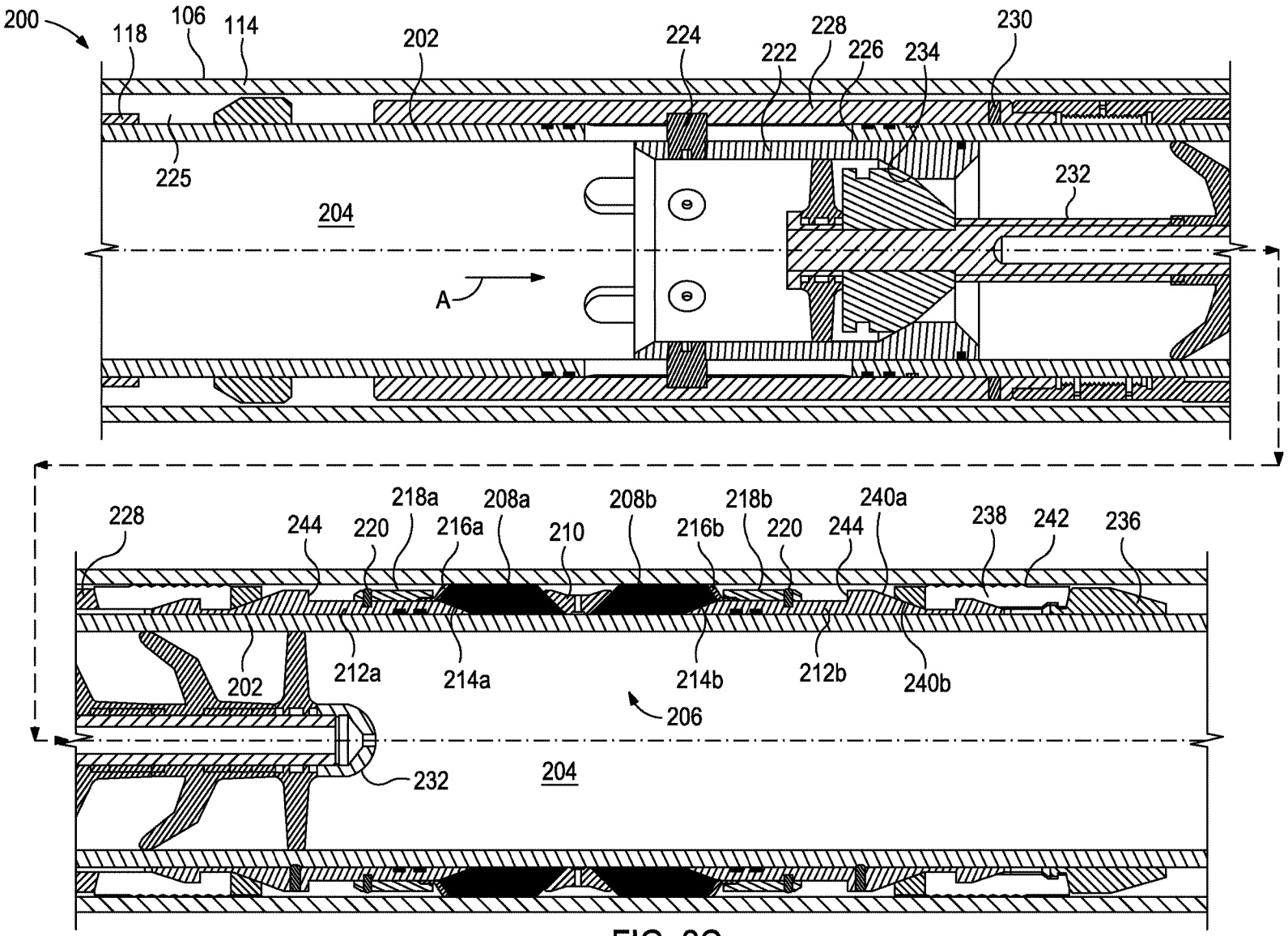
Figure 2D:
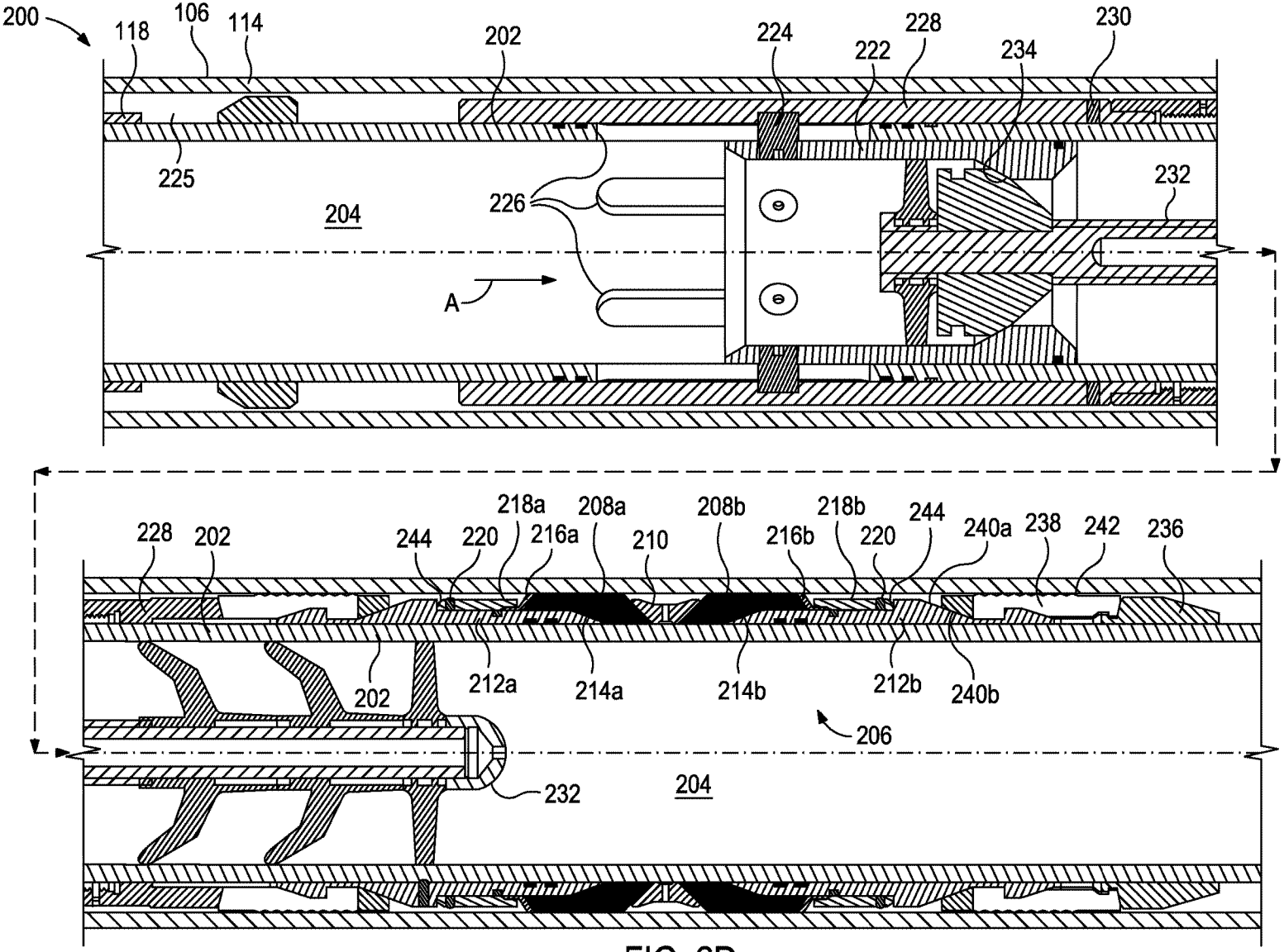

Referring now to FIGS. 2A-2D, with continued reference to FIG. 1, illustrated are progressive cross-sectional side views of an exemplary wellbore isolation device 200, according to one or more embodiments. FIGS. 2A and 2B depict the wellbore isolation device 200 (hereafter "the device 200") in a run-in or unset configuration, FIG. 2C depicts the device 200 in a partially set configuration, and FIG. 2D depicts the device 200 in a fully set configuration. The device 200 may be the same as or similar to the wellbore isolation device 116 of FIG. 1. Accordingly, the device 200 may be extendable within the wellbore 106, which may be lined with casing 114. In some embodiments, however, the casing 114 may be omitted and the device 200 may alternatively be deployed in an open-hole section of the wellbore 106, without departing from the scope of the disclosure.

As illustrated, the device 200 may include an elongate, cylindrical body 202 that defines an interior 204. The body 202 may be coupled or operatively coupled to the conveyance 118 such that the interior 204 of the body 202 is fluidly coupled to and otherwise forms an axial extension of an interior of the conveyance 118.

The device 200 may further include a packer assembly 206 disposed about the body 202. The packer assembly 206 may include a first or upper sealing element 208*a*, a second or lower sealing element 208*b*, and a spacer 210 that interposes the upper and lower sealing elements 208*a,b*. The upper and lower sealing elements 208*a,b* may be made of a variety of pliable or supple materials such as, but not limited to, an elastomer, a rubber (e.g., nitrile butadiene rubber, hydrogenated nitrile butadiene rubber), a polymer (e.g., polytetrafluoroethylene or TEFLON®, AFLAS®; CHEMRAZ®, etc.), a ductile metal (e.g., brass, aluminum, ductile steel, etc.), or any combination thereof. The spacer 210 may comprise an annular ring that extends about the body 202 and, as described in greater detail below, may exhibit a unique concave or inverse airfoil design that helps mitigate swabbing of the upper and lower sealing elements 208*a,b* while moving within the wellbore 106, or while fluids are circulating past the upper and lower sealing elements 208*a,b* while the device 200 is held stationary in the wellbore 106.

The packer assembly 206 may also include an upper shoulder 212*a* and a lower shoulder 212*b* and the upper and lower sealing elements 208*a,b* may be axially positioned between the upper and lower shoulders 212*a,b*. As illustrated, the upper shoulder 212*a* may provide an upper ramped surface 214*a* engageable with the upper sealing element 208*a*, and the lower shoulder 212*b* may provide a lower ramped surface 214*b* engageable with the lower sealing element 208*b*. As further described below, the upper and lower sealing elements 208*a,b* may be axially compressed between the upper and lower shoulders 212*a,b*, and the upper and lower ramped surfaces 214*a,b* may help urge the upper and lower sealing elements 208*a,b* to extend radially into engagement with the inner wall of the casing 114. Such a configuration is often referred to as a "propped element" configuration. It will be appreciated, however, that the principles of the present disclosure may equally apply to non-propped embodiments; i.e., where the upper and lower ramped surfaces 214*a,b* are omitted from the upper and lower shoulders 212*a,b*, respectively, without departing from the scope of the disclosure. In such embodiments, the ends of the upper and lower shoulders 212*a,b* may be squared off, for example.

The packer assembly 206 may further include an upper support shoe 216*a*, a lower support shoe 216*b*, an upper cover sleeve 218*a*, and a lower cover sleeve 218*b*. As illustrated, the upper and lower cover sleeves 218*a,b* may be coupled to corresponding outer surfaces of the upper and lower shoulders 212*a,b*, respectively, using one or more frangible members 220. The frangible members 220 may comprise, for example, a shear pin or a shear ring. Securing the upper and lower cover sleeves 218*a,b* to the upper and lower shoulders 212*a,b*, respectively, may also serve to secure the upper and lower support shoes 216*a,b* against the corresponding outer surfaces of the upper and lower shoulders 212*a,b*, respectively. Moreover, as described in greater detail below, the upper and lower support shoes 216*a,b* may extend axially over a portion of the upper and lower sealing elements 208*a,b*, respectively, and thereby help mitigate swabbing effects.

The device 200 may further include a setting sleeve 222 positioned within the body 202 and axially movable within the interior 204. As illustrated, the setting sleeve 222 may include one or more setting pins 224 spaced circumferentially about the setting sleeve 222 and extending through corresponding elongate orifices 226 defined axially along a portion of the body 202. The setting pins 224 may be configured to couple the setting sleeve 222 to a piston 228 arranged about the outer surface of the body 202. In some embodiments, the piston 228 may be coupled to the body 202 using one or more frangible members 230, such as a shear pin or a shear ring.

Exemplary operation of the device 200 in transitioning between the unset configuration, as shown in FIG. 2A, and the fully set configuration, as shown in FIG. 2D, is now provided. The device 200 may be run into the wellbore 106 until locating a target destination. As the device 200 is run downhole, fluids present in the wellbore 106 flow across the packer assembly 206 within an annulus 225 defined between the casing 114 and the device 200. High velocity fluid flowing across the upper and lower sealing elements 208*a,b* may result in a pressure drop within the annulus 225 that tends to pull the upper and lower sealing elements 208*a,b* radially outward and toward the inner wall of the casing 114. Radial extension of the upper and lower sealing elements 208*a,b* may result in swabbing and/or contacting the casing 114, which may slow the progress of the device 200, damage the upper and lower sealing elements 208*a,b*, and/or result in the premature setting of the device 200. The unique designs and configurations of the spacer 210 and the upper and lower support shoes 216*a,b*, however, as described in greater detail below, may help mitigate swabbing of the upper and/or lower sealing elements 208*a,b*, and thereby allow faster run-in speeds and protection of the upper and lower sealing elements 208*a,b*.

Referring to FIG. 2B, upon reaching the target destination within the wellbore 106 where the device 200 is to be deployed, a wellbore projectile 232 may be introduced into the conveyance 118 and advanced to the device 200. The wellbore projectile 232 may comprise, but is not limited to, a dart, a plug, or a ball. In some embodiments, the wellbore projectile 232 may be pumped to the device 200. In other embodiments, however, the wellbore projectile 232 may freely fall to the target location under the force of gravity. Upon reaching the device 200, the wellbore projectile 232 may locate and otherwise land on a seat 234 defined on the setting sleeve 222. Once the wellbore projectile 232 engages the setting sleeve 222, a hydraulic seal may be generated within the interior 204 of the body 202.

Increasing the fluid pressure within the interior 204 above the setting sleeve 222 may place a hydraulic load on the wellbore projectile 232, which may correspondingly place an axial load on the setting sleeve 222 in the direction A and, therefore, on the piston 228 via the setting pins 224. Further increasing the fluid pressure may increase the axial load transferred to the piston 228, which may eventually reach a predetermined shear value of the frangible member(s) 230 that secure the piston 228 to the body 202. Upon reaching or otherwise exceeding the predetermined shear value, the frangible member(s) 230 may fail and thereby allow the setting sleeve 222 and the piston 228 to axially translate in the direction A.

In other embodiments, as will be appreciated, the axial load required to shear the frangible member(s) 230 and otherwise move the setting sleeve 222 and the piston 228 in the direction A may be accomplished in other ways. For instance, in at least one embodiment, the piston 228 may be moved in the direction A under the control of an actuation mechanism such as, but not limited to, a mechanical actuator, an electromechanical actuator, a hydraulic actuator, or a pneumatic actuator, without departing from the scope of the disclosure. In such embodiments, the setting sleeve 222 may be omitted from the device 200 and the piston 228 may be alternatively moved by actuation of the actuation mechanism.

Those skilled in the art will readily appreciate that there are numerous ways to move the piston 228 in the direction A, without departing from the principles described herein. Nonetheless, those skilled in the art will also readily appreciate the advantage of using the setting sleeve 222 as opposed to conventional internal hydraulic paths that may be used to move the piston 228. Such hydraulic paths often become clogged with debris, and thereby frustrate the operation. The setting sleeve 222 embodiment, however, convert hydraulic pressure into an applied axial load via the seat 234 into the pins 224 and subsequently into the piston 228. Accordingly, the setting sleeve 222 removes the need for the hydraulic paths and, as a result, makes the device highly debris tolerant.

Referring to FIG. 2C, as the piston 228 translates axially in the direction A, the upper and lower sealing elements 208*a,b* may become axially compressed and thereby expand radially into engagement with the inner wall of the casing 114. More particularly, as the piston 228 translates axially in the direction A, a lower end of the piston 228 may engage and force the upper shoulder 212*a* toward the lower shoulder 212*b*, and thereby place a compressive load on the upper and lower sealing elements 208*a,b*. In some embodiments, one or both of the upper and lower shoulders 212*a,b* may be secured to the body 202, such as through the use of one or more frangible members (not shown), and the axial load from the piston 228 may be configured to shear the frangible member and otherwise free the upper and/or lower shoulders 212*a,b* for axial movement. Moreover, as the upper shoulder 212*a* is urged toward the lower shoulder 212*b*, the upper and lower ramped surfaces 214*a,b* may extend beneath and urge the upper and lower sealing elements 208*a,b* radially into engagement with the inner wall of the casing 114. Upon engaging the inner wall of the casing 114, the device 200 may be considered to be in a partially set configuration.

In some embodiments, the device 200 may include an end ring 236 fixed to the body 202 below the packer assembly 206 to prevent the packer assembly 206 from moving further down the body 202 as the piston 228 moves in the direction A. In at least one embodiment, the lower shoulder 212*b* may engage a lower slip 238 axially positioned between the end ring 236 and the lower shoulder 212*b*. The lower slip 238, in some cases, may comprise an axial extension of the end ring 236. The lower shoulder 212*b* may define and otherwise provide an angled surface 240*a* configured to slidlingly engage a corresponding angled surface 240*b* of the lower slip 238 as the lower shoulder 212*b* is urged in the direction A by the piston 228. Sliding engagement between the lower shoulder 212*b* and the lower slip 238 may force the lower slip 238 into gripping engagement with the inner wall of the casing 114. In some embodiments, the lower slip 238 may define and otherwise provide a plurality of gripping elements 242 on its outer surface. The gripping elements 242 may comprise, for example, teeth or annular grooves, but may equally comprise an abrasive material or substance. The gripping elements may be configured to cut or brinnell into the inner wall of the casing 114 to secure the device 200 in its axial position within the wellbore 106.

In at least one embodiment, the lower slip 238 may be omitted from the device 200, and the lower shoulder 212*b* may instead directly engage the end ring 236. In such embodiments, the friction between the sealing elements

208*a,b* and the inner wall of the casing 114 may provide sufficient gripping engagement for the packer 206.

Referring to FIG. 2D, continued application of hydraulic force on the wellbore projectile 232 may allow the device 200 to transition into the fully set position. More particularly, as the piston 228 continues to move in the direction A, the upper and lower shoulders 212*a,b* may correspondingly continue to move beneath the upper and lower sealing elements 208*a,b*, respectively. As a result, the upper and lower sealing elements 208*a,b* may begin to plastically deform the upper and lower support shoes 216*a,b* and eventually place an axial load on the upper and lower cover sleeves 218*a,b*, respectively, via the support shoes 216*a,b*. Continued movement of the piston 228 in the direction A may urge the sealing elements 208*a,b* and corresponding support shoes 216*a,b* against the cover sleeves 218*a,b* until eventually reaching a predetermined shear value of the frangible member(s) 220 that secure the cover sleeves 218*a,b* to the shoulders 212*a,b*. In some cases, the frangible member(s) 220 that secure the upper cover sleeve 218*a* to the upper shoulders 212*a* may exhibit the same predetermined shear value for the frangible member(s) 220 that secure the lower cover sleeve 218*b* to the lower shoulder 212*b*. In other case, however, the predetermined shear value may be different, and thereby provide a staged sequential shearing of the cover sleeves 218*a,b*.

Upon reaching or otherwise exceeding the predetermined shear value(s), the frangible member(s) 220 may fail and thereby allow the cover sleeves 218*a,b* to move in opposing axial directions until engaging a radial shoulder 244 defined on each shoulder 212*a,b*, which effectively stops axial movement of the cover sleeves 218*a,b* with respect to the shoulders 212*a,b*. The upper and lower sealing elements 208*a,b* may then proceed to plastically deform the upper and lower support shoes 216*a,b*, as described in more detail below, and radially expand to sealingly engage the inner wall of the casing 114 and thereby provide fluid isolation within the wellbore 106 at the location of the device 200.

Figure 3B:
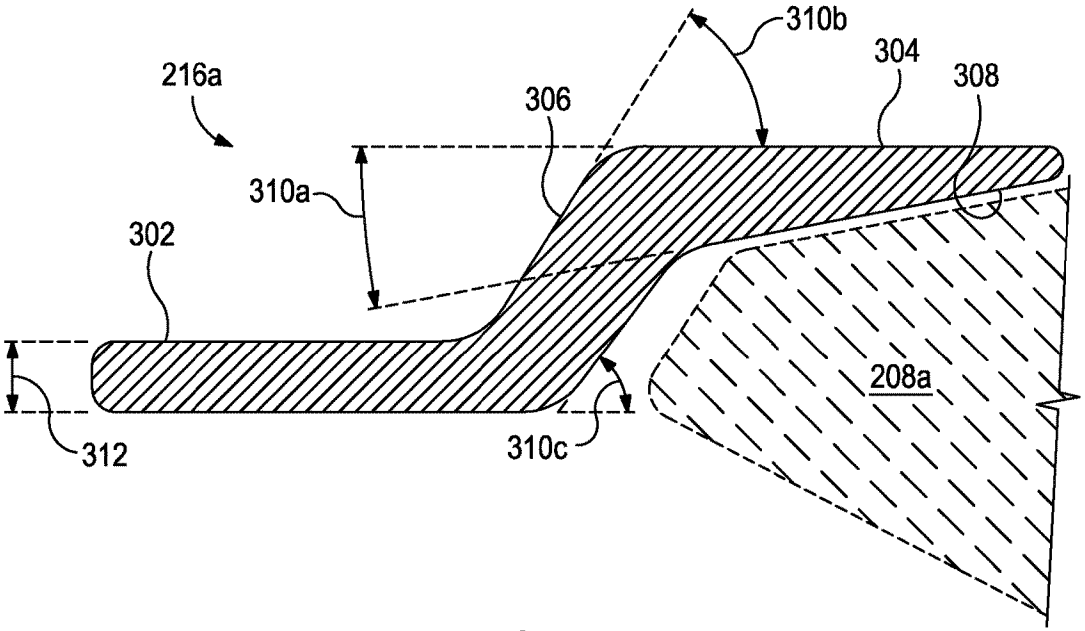
FIGS. 3A and 3B depict cross-sectional side views of the upper support shoe of FIGS. 2A-2D.
Figure 3A:
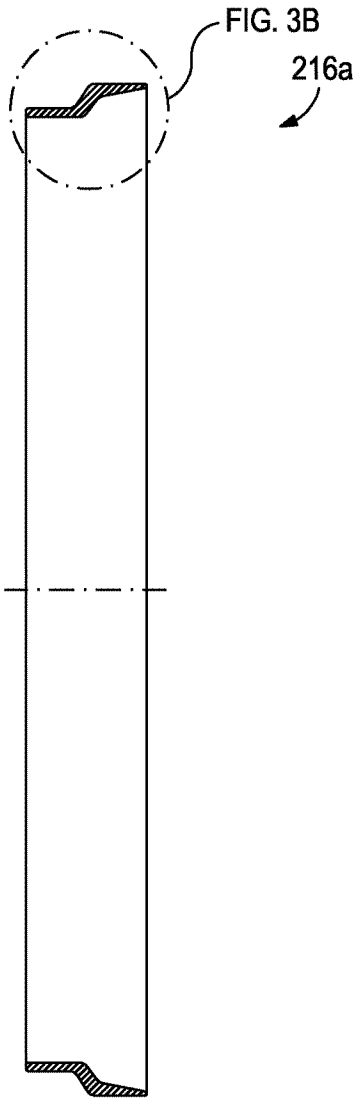

Referring now to FIGS. 3A and 3B, with continued reference to FIGS. 2A-2D, illustrated are cross-sectional side views of the upper support shoe 216*a*, according to one or more embodiments. More particularly, FIG. 3A depicts a cross-sectional side view of the entire upper support shoe 216*a*, and FIG. 3B depicts an enlarged cross-sectional side view of a portion of the upper support shoe 216*a*, as indicated in FIG. 3A. The upper support shoe 216*a* may be representative of both the upper and lower support shoes 216*a,b*. Accordingly, discussion of the upper support shoe 216*a* in conjunction with the upper sealing element 208*a* (shown in dashed lines), may equally apply to the lower support shoe 216*b* (FIGS. 2A-2D) in conjunction with the lower sealing element 208*b* (FIGS. 2A-2D).

The upper support shoe 216*a* acts as a rigid axial and radial support for the upper sealing element 208*a* but may be plastically deformed as the upper sealing element 208*a* moves to the fully set configuration. Accordingly, the upper support shoe 216*a* may be made of a malleable or ductile material such as, but not limited to, iron, carbon steel, brass, aluminum, stainless steel, a wire mesh, a para-aramid synthetic fiber (e.g., KEVLAR®), a thermoplastic (e.g., nylon, polytetrafluoroethylene, polyvinyl chloride, etc.), any combination thereof, and any alloy thereof. More generally, the material for the upper support shoe 216*a* may comprise any metal or metal alloy with a percent elongation ranging between about 10% and about 40% or any thermoplastic with a percent elongation ranging between about 10% and about 100%.

In operation, the upper support shoe 216*a* may help reduce the effects of flow induced swabbing of the upper sealing element 208*a* and reduce or eliminate extrusion of the material of the upper sealing element 208*a* due to differential pressures assumed during run-in and setting. To accomplish this, as illustrated, the upper support shoe 216*a* may comprise an annular structure with a generally S-shaped cross-section. More particularly, the upper support shoe 216*a* may include and otherwise provide a jogged leg 302, a lever arm 304, and a fulcrum section 306 that extends between and connects the jogged leg 302 and the lever arm 304. The lever arm 304 may be configured to extend axially over a portion of the upper sealing element 208*a*, and thereby help mitigate swabbing of the upper sealing element 208*a* at the corresponding end.

As illustrated, a bottom surface 308 of the lever arm 304 may extend at a first angle 310*a* with respect to horizontal, and the fulcrum section 306 may extend from the jogged leg 302 at a second angle 310*b* with respect to horizontal. The first angle 310*a* may range between about 5° and about 45° and may be configured to accommodate the structure of the upper sealing element 208*a* to extend thereabove and increase swab resistance. The second angle 310*b* may be equal to or greater than the first angle 310*a*, and may range between about 45° and about 90°. In some cases, the inner surface of the fulcrum section 306 may extend from the jogged leg 302 at a third angle 310*c*, which may or may not be the same as the second angle 310*b*. The second and third angles 310*b,c* may be different, for example, if it is required to be able to deform the lever arm 304. As will be appreciated, the angles 310*a-c* may be optimized to ensure that the upper sealing element 208*a* successfully pushes and plastically deforms the lever arm 304 radially outward and toward the inner wall of the casing 114 (FIGS. 2A-2D) while moving to the fully set position.

Figure 5A:
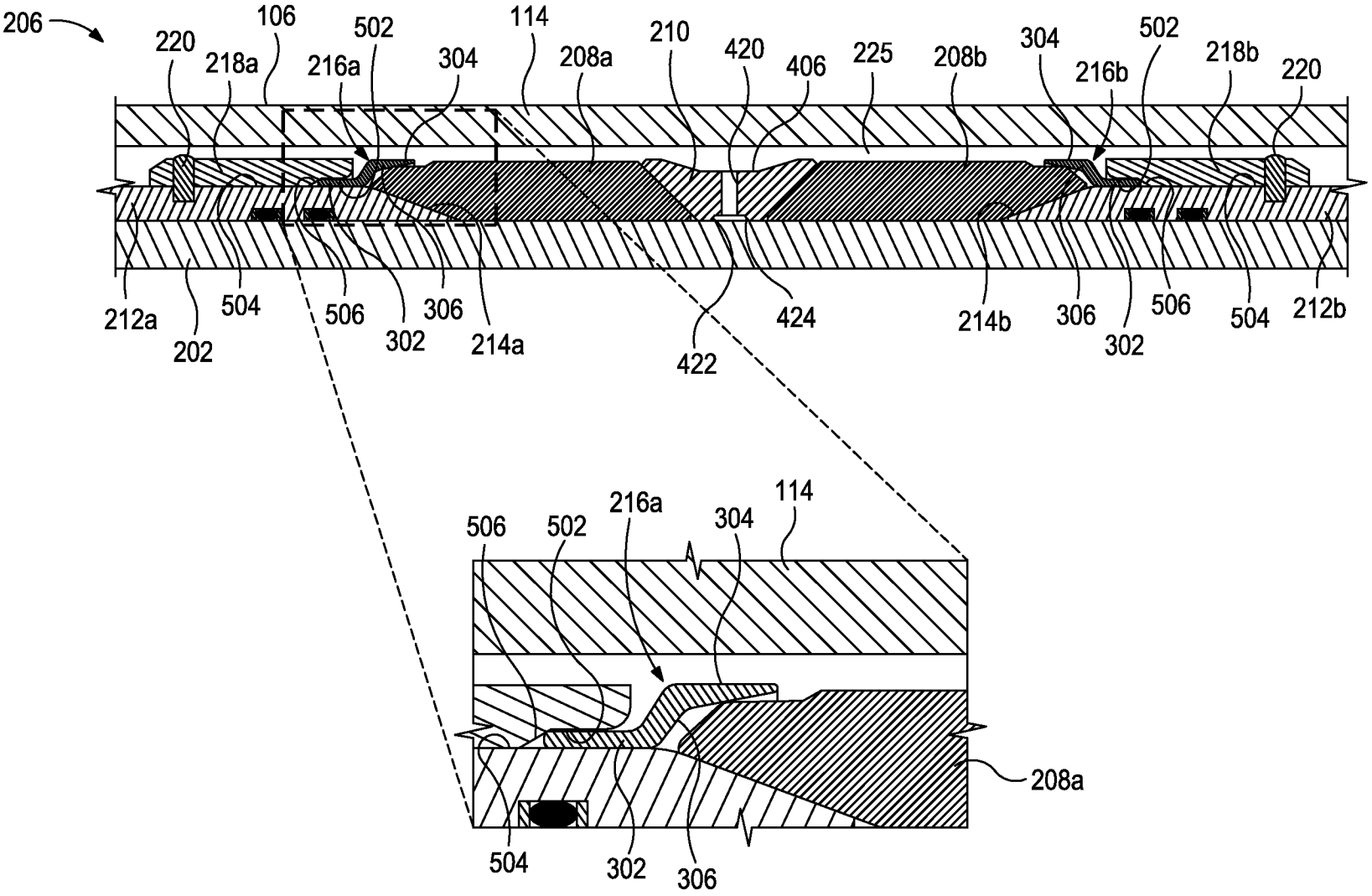
FIGS. 5A and 5B depict enlarged cross-sectional side views of a portion of the packer assembly 206 of FIGS. 2A-2D.
Figure 5B:
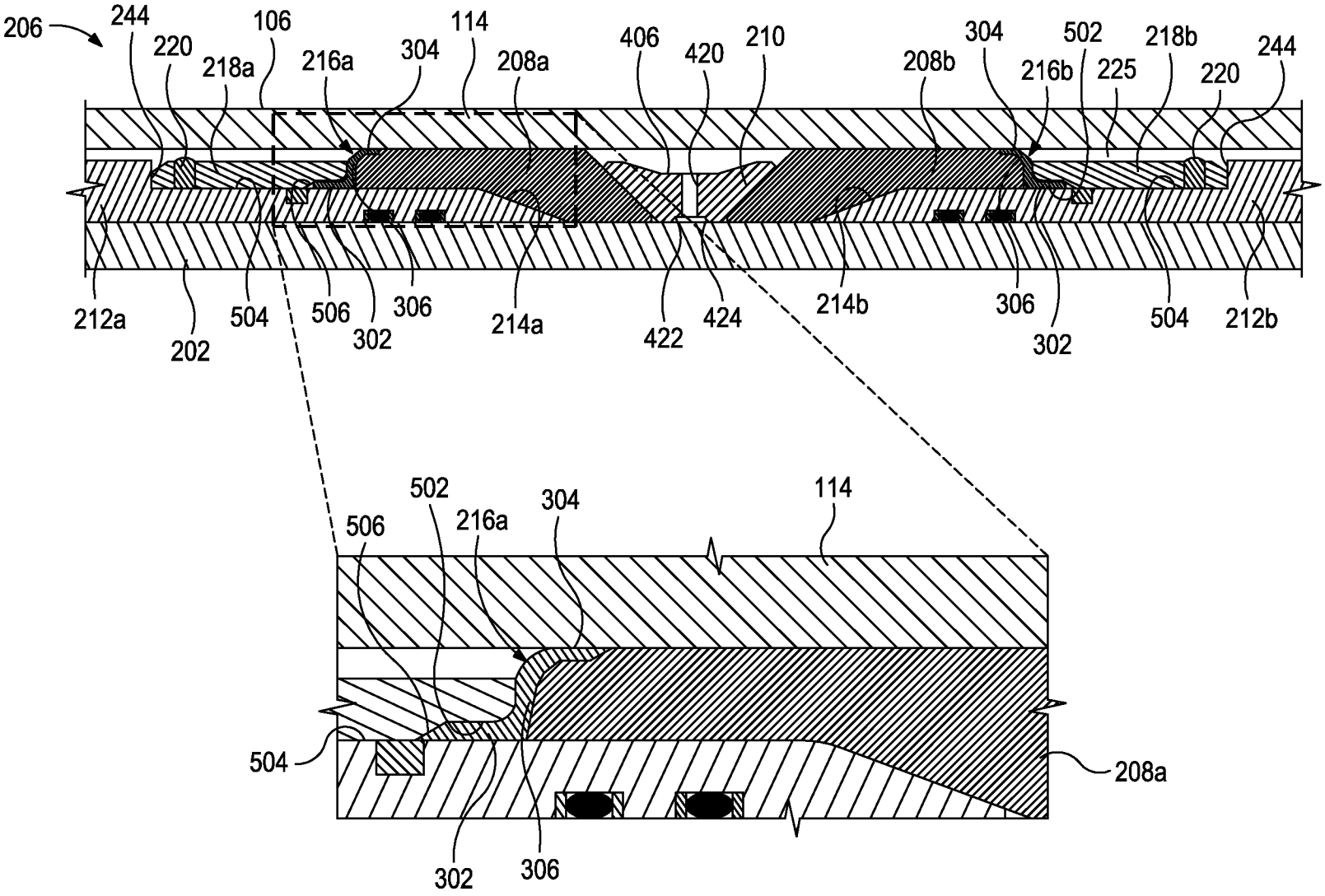

As described below, the jogged leg 302 may be configured to be received within a gap 502 (FIGS. 5A and 5B) defined between the upper cover sleeve 218*a* (FIGS. 5A and 5B) and the upper shoulder 212*a* (FIGS. 5A and 5B). The gap 502 may be an axial extension of an extrusion gap, into which the material of the upper sealing element 208*a* may be prone to creep. The jogged leg 302, however, may exhibit a depth or thickness 312 sufficient to be received into the gap 502 and, upon moving to the fully set position, the jogged leg 302 may plastically deform and thereby form a seal within the gap 502 that substantially prevents material from the upper sealing element 208*a* from creeping into the extrusion gap. As a result, seals, back-up rings, or other extrusion-preventing devices may be omitted from the packer assembly 206 (FIGS. 2A-2D), thereby increasing reliability and reducing the number of components required in the packer assembly 206.

Figure 4B:
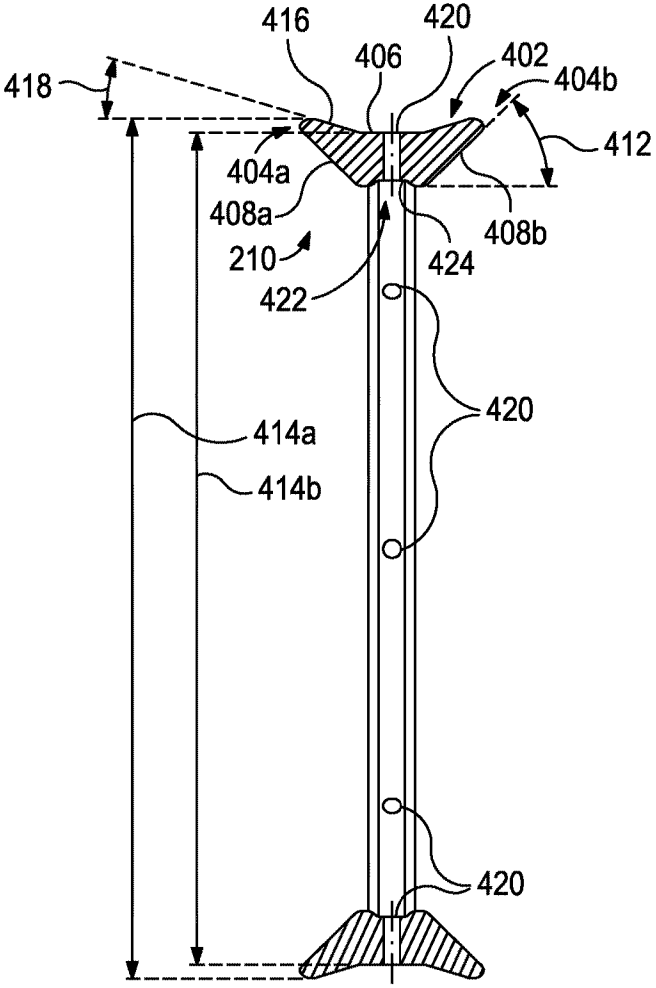
FIGS. 4A and 4B depict cross-sectional end and side views of the spacer of FIGS. 2A-2D.
Figure 4A:
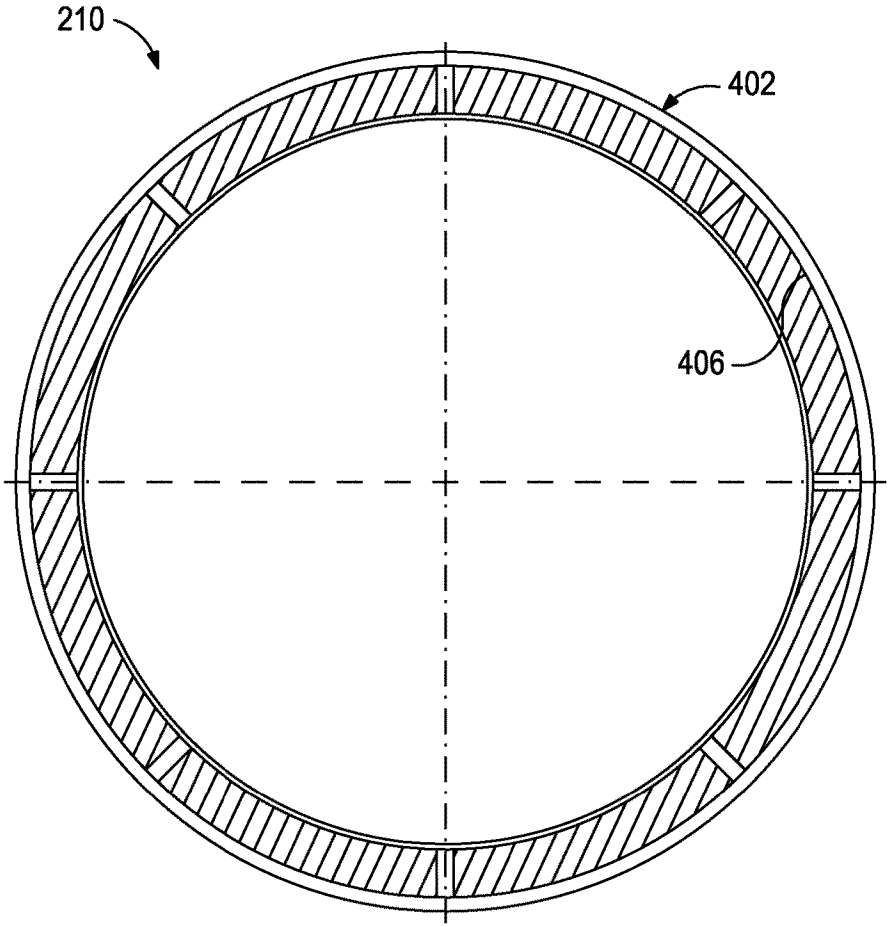

Referring now to FIGS. 4A and 4B, with continued reference to FIGS. 2A-2D, illustrated are cross-sectional end and side views of the spacer 210, respectively, according to one or more embodiments. As illustrated, the spacer 210 may comprise an annular body 402 that provides a first or upper end 404*a*, a second or lower end 404*b*, and a recessed portion 406 that extends between the upper and lower ends 404*a,b*. The body 402 may be made of a variety of rigid or semi-rigid materials including, but not limited to, a metal (e.g., heat-treated steel, brass, aluminum, etc.), an elastomer, a rubber, a plastic, a composite, a ceramic, or any combination thereof.

As indicated above, the spacer 210 may interpose the upper and lower sealing elements 208*a,b* (FIGS. 2A-2D). The upper end 404*a* may provide an upper angled surface

408*a* configured to engage the upper sealing element 208*a*, and the lower end 404*b* may provide a lower angled surface 408*b* configured to engage the lower sealing element 208*b*. The upper and lower angled surfaces 408*a,b* may exhibit an angle 412 ranging between about 25° and about 75° from horizontal. In some embodiments, one or both of the upper and lower angled surfaces 408*a,b* may comprise a combination of two or more angles to better engage the upper and lower sealing elements 208*a,b*. Accordingly, the upper and lower angled surfaces 408*a,b* may be configured to help mitigate swabbing of the upper and lower sealing elements 208*a,b* at the corresponding ends.

The body 402 may define and otherwise provide an inverse airfoil design. More particularly, the ends 404*a,b* of the body 402 may exhibit a first diameter 414*a* and the recessed portion 406 of the body 402 may exhibit a second diameter 414*b* that is smaller than the first diameter 414*a*. In some embodiments, the inner diameter 414*b* may be designed and otherwise configured to be smaller than the outer diameter 414*a* by a percentage ranging between about 1% and about 10%. The ends 404*a,b* may transition to the recessed portion 406 via a tapered surface 416 that may extend at an angle 418 from horizontal, where the angle 418 may range between about 5° and about 75.

The body 402 may further define or otherwise provide one or more equalization ports 420 that extend radially through the body 402 to fluidly communicate with a dead space 422. The dead space 422 may be partially defined by an annular groove 424 defined into the bottom of the body 402 and the outer surface of the body 202 (FIGS. 2A-2D) of the device 200 (FIGS. 2A-2D). Accordingly, the equalization ports 420 may extend radially through the body 402 from the recessed portion 406 to the annular groove. The equalization ports 420 may facilitate pressure equalization between the dead space 422 and the annulus 225 (FIGS. 2A-2D). More particularly, the equalization ports 420 may allow for the accumulation of high pressure in the dead space 422, which can reduce swabbing effects on the upper and/or lower sealing elements 208*a,b* (FIGS. 2A-2D) during run-in. The equalization ports 420 may also be configured to help maintain the spacer 210 in position on the body 202, so that high pressures assumed during run-in do not move it and thereby adversely affect the upper and/or lower sealing elements 208*a,b*.

Referring now to FIGS. 5A and 5B, with continued reference to FIGS. 3A-3B and 4A-4B, illustrated are enlarged cross-sectional side views of a portion of the packer assembly 206 of FIGS. 2A-2D, according to one or more embodiments. More particularly, FIG. 5A depicts the packer assembly 206 in the unset position, and FIG. 5B depicts the packer assembly 206 in the fully set position, as generally described above. When the packer assembly 206 is being run downhole within the casing 114, fluids present within the annulus 225 flow across the packer assembly 206 and, more particularly, across the upper and lower sealing elements 208*a,b*. The run-in speed may, therefore, result in high velocity fluid flowing across the upper and lower sealing elements 208*a,b*, which results in a pressure drop within the annulus 225 that urges the upper and lower sealing elements 208*a,b* radially outward and toward the inner wall of the casing 114. As extending partially over each sealing element 208*a,b*, the lever arm 304 of each support shoe 216*a,b*, respectively, may operate to help prevent swabbing as the high velocity fluid flows across the upper and lower sealing elements 208*a,b*.

The inverse airfoil design of the spacer 210, however, may prove advantageous in mitigating the effects of the pressure drop. More particularly, the recessed portion 406 of the spacer 210 may create a low-pressure, high velocity zone that helps to divert the fluid flow away from the outer surface of the upper sealing element 208*a*, which is the sealing element that typically sets prematurely in swabbing during run-in. As a result, the spacer may prove advantageous in preventing the upper and/or lower sealing elements 208*a,b* from lifting radially toward the inner wall of the casing 114 and thereby mitigating swabbing. Moreover, as indicated above, besides creating a low-pressure, high velocity zone in the recessed portion 406, the upper and lower angled surfaces 408*a,b* (FIG. 4B) may also help mitigate swabbing of the upper and lower sealing elements 208*a,b* at the corresponding ends of the sealing elements 208*a,b*.

As discussed above, the upper and lower cover sleeves 218*a,b* may be configured to secure the upper and lower support shoes 216*a,b* against corresponding outer surfaces of the upper and lower shoulders 212*a,b*, respectively. More particularly, each cover sleeve 218*a,b* may provide and otherwise define a gap 502 configured to receive the jogged leg 302 of the corresponding support shoe 216*a,b*. The gap 502 may be an axial extension of an extrusion gap 504 defined between the shoulders 212*a,b* and the cover sleeves 218*a,b*. If the extrusion gap 504 is not properly sealed off, the upper and lower sealing elements 208*a,b* may creep and otherwise extrude into the extrusion gap 504 over time, and thereby compromise the sealing integrity of the packer assembly 206. The jogged leg 302 may be configured to produce a seal within the gap 502 that substantially prevents material from the upper and lower sealing elements 208*a,b* from creeping into the extrusion gap 504.

More specifically, upon moving the packer assembly 206 to the fully set position, as shown in FIG. 5B, the upper and lower sealing elements 208*a,b* may engage and plastically deform the upper and lower support shoes 216*a,b*, respectively. For example, the lever arm 304 may be plastically deformed radially outward and toward the inner wall of the casing 114. In some embodiments, a metal-to-metal seal may result at the interface between the lever arm 304 and the casing 114. The ductile material of the upper and lower support shoes 216*a,b* may prove advantageous in allowing the lever arm 304 to conform to irregularities in the inner wall of the casing 114. As a result, the lever arm 304 may be more capable of preventing extrusion of the upper and lower sealing elements 308*a,b* at the interface between the casing 114 and the lever arm 304.

The jogged leg 302 of each support shoe 216*a,b* may also be plastically deformed and thereby generate a metal-to-metal seal and/or an interference fit within the gap 502. More specifically, the gap 502 may further provide a tapered mating surface 506, which may be defined by the corresponding upper and lower cover sleeves 218 or a combination of the upper and lower cover sleeves 218 and the corresponding upper and lower shoulders 212*a,b*. As the upper and lower sealing elements 208*a,b* engage and plastically deform the upper and lower support shoes 216*a,b*, respectively, the jogged legs 302 may be forced into engagement with the tapered mating surface 506. Forcing the jogged leg 302 against the tapered mating surface 506 may result in the formation of a metal-to-metal seal, an interference fit, a press fit, etc., or any combination thereof within the gap 502. Such engagement between the jogged leg 302 and the tapered mating surface 506 may prevent material from the upper and lower sealing elements 208*a,b* from creeping into the extrusion gap 504. As will be appreciated, this may prove advantageous in increasing the squeeze percentage of the packer assembly 206 and removing the need for seals, back-up rings, or other extrusion-preventing devices typically used in packer assemblies at the extrusion gap 504.

Typical packer assemblies are able to withstand 3-10 barrels per minute (bpm) of circulation past their sealing elements, and 4,000 psi to 8,000 psi service pressure without usually resulting in swabbing of the associated sealing elements on the packer assembly 206 in the unset position. The novel features and configurations of the presently-disclosed packer assembly 206 may allow faster run-in speeds and higher circulation rates, without increasing the risk of swabbing or pre-setting the sealing elements 208*a,b*. For example, the unique design of the spacer 210 and the presently disclosed support shoes 216*a,b* has allowed the disclosed packer assembly 206 to be tested to withstand 32 bpm circulation and 11,500 psi without resulting in swabbing. As will be appreciated, the designs that assist in swab resistance also benefit the pressure integrity of the packer assembly 206. Both the support shoes 216*a,b* and the spacer 210 protect the exposed ends of the sealing elements 208*a,b* to mitigate effects of swab, and the cover sleeves 218*a,b* and the jogged legs 302 of the support shoes 216*a,b* prevent the sealing elements 208*a,b* from extruding during operation. As a result, the packer assembly 206 may allow for faster run-in speeds and higher circulation rates. Moreover, this may enable the ability to use the device 200 (FIGS. 2A-2D) in higher pressure and high temperature environments. Furthermore, due to its robust mechanical operation, the device 200 may also be highly debris and fluid tolerant.

Embodiments disclosed herein include:

A. A packer assembly includes an elongate body, at least one sealing element disposed about the elongate body, a shoulder disposed about the elongate body and positioned axially adjacent the at least one sealing element, a cover sleeve coupled to an outer surface of the shoulder, and an annular support shoe having a jogged leg, a lever arm, and a fulcrum section that extends between and connects the jogged leg to the lever arm, wherein the jogged leg is received within a gap defined between the cover sleeve and the shoulder, and the lever arm extends axially over a portion of the sealing element.

B. A method that includes introducing a packer assembly into a wellbore lined at least partially with casing, the packer assembly including an elongate body, at least one sealing element disposed about the elongate body, a shoulder disposed about the elongate body and positioned axially adjacent the at least one sealing element, a cover sleeve coupled to an outer surface of the shoulder, and an annular support shoe having a jogged leg, a lever arm, and a fulcrum section that extends between and connects the jogged leg to the lever arm, wherein the jogged leg is received within a gap defined between the cover sleeve and the upper shoulder, and the lever arm extends axially over a portion of the sealing element. The method further includes mitigating swabbing of the sealing element with the lever arm as extended over the portion of the upper sealing element as the packer assembly is run into the wellbore, moving the packer assembly from an unset configuration, where the sealing element is radially unexpanded, and a set configuration, where the sealing element is radially expanded to sealingly engage an inner wall of the casing, and generating a seal within the gap with the jogged leg as the packer assembly moves to the set configuration.

C. A support shoe for a sealing element of a packer assembly includes an annular body made of a ductile material and providing a jogged leg, a lever arm, and a fulcrum section that extends between and connects the jogged leg to the lever arm, wherein the jogged leg is sized to be received within a gap defined between a cover sleeve and a shoulder of the packing assembly, wherein the lever arm extends at an angle to extend axially over a portion of the sealing element, and wherein the jogged leg and the lever arm are plastically deformable when the sealing element moves to a fully set position.

Each of embodiments A, B, and C may have one or more of the following additional elements in any combination: Element 1: further comprising a tapered mating surface provided in the gap to plastically deform the jogged leg upon moving the packer assembly to a fully set position. Element 2: wherein the gap extends from an extrusion gap defined between the shoulder and the cover sleeve, and the jogged leg generates a seal within the gap upon being plastically deformed, wherein the seal prevents the sealing element from creeping into the extrusion gap. Element 3: wherein the tapered mating surface is defined by the cover sleeve. Element 4: wherein the support shoe comprises a ductile material that exhibits a percent elongation ranging between 10% and 100%. Element 5: wherein the support shoe comprises a ductile material selected from the group consisting of iron, carbon steel, brass, aluminum, stainless steel, a wire mesh, a para-aramid synthetic fiber, a thermoplastic, any alloy thereof, and any combination thereof. Element 6: wherein the lever arm has a bottom surface that extends at a first angle from horizontal and the fulcrum section extends from the jogged leg at a second angle, the second angle being equal to or greater than the first angle. Element 7: wherein the first angle ranges between 5° and 45° from horizontal and the second angle ranges between 45° and 75°.

Element 8: wherein a tapered mating surface is provided in the gap and generating the seal within the gap with the jogged leg comprises engaging the sealing element on the support shoe and thereby forcing the jogged leg against the tapered mating surface, and plastically deforming the jogged leg against the tapered mating surface to generate the seal in the gap. Element 9: wherein mitigating swabbing of the sealing element with the lever arm comprises providing a rigid axial and radial support for the sealing element with the lever arm. Element 10: wherein moving the packer assembly from the unset configuration to the set configuration further comprises engaging the sealing element on the support shoe and plastically deforming the lever arm radially outward and toward an inner wall of the casing. Element 11: further comprising forming a metal-to-metal seal at an interface between the casing and the lever arm. Element 12: wherein an extrusion gap is defined between the shoulder and the cover sleeve, the method further comprising preventing the sealing element from creeping into the extrusion gap with the seal generated by the jogged leg.

Element 13: wherein a tapered mating surface provided in the gap plastically deforms the jogged leg and generates a seal within the gap upon moving the sealing element to the fully set position. Element 14: wherein the ductile material exhibits a percent elongation ranging between 10% and 100%. Element 15: wherein the ductile material is selected from the group consisting of iron, carbon steel, brass, aluminum, stainless steel, a wire mesh, a para-aramid synthetic fiber, a thermoplastic, any alloy thereof and any combination thereof. Element 16: wherein the lever arm has a bottom surface that extends at a first angle from horizontal and the fulcrum section extends from the jogged leg at a second angle, the second angle being equal to or greater than the first angle. Element 17: wherein the first angle ranges between 5° and 45° from horizontal and the second angle ranges between 45° and 75°.

By way of non-limiting example, exemplary combinations applicable to A, B, and C include: Element 1 with Element 2; Element 1 with Element 3; Element 6 with Element 7; Element 10 with Element 11; and Element 16 with Element 17.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A packer assembly, comprising:

an elongate body;

an upper sealing element disposed about the elongate body;

a lower sealing element disposed about the elongate body;

a spacer with an inverse airfoil design interposed between the upper sealing element and the lower sealing element, wherein an upper end of the spacer provides an upper angled surface adapted to engage the upper sealing element and a lower end of the spacer provides a lower angled surface adapted to engage the lower sealing element, and wherein a concave surface defined by the inverse airfoil design faces radially outward;

a shoulder disposed about the elongate body and positioned axially adjacent the upper sealing element and the lower sealing element;

a cover sleeve coupled to an outer surface of the shoulder; and an annular support shoe having a jogged leg, a lever arm, and a fulcrum section that extends between and connects the jogged leg to the lever arm, wherein the jogged leg is received within a gap defined between the cover sleeve and the shoulder, and the lever arm extends axially over a portion of the sealing element.

2. The packer assembly of claim 1, further comprising a tapered mating surface provided in the gap to plastically deform the jogged leg upon moving the packer assembly to a fully set position.

3. The packer assembly of claim 2, wherein the gap extends from an extrusion gap defined between the shoulder and the cover sleeve, and the jogged leg generates a seal within the gap upon being plastically deformed, wherein the seal prevents the sealing element from creeping into the extrusion gap.

4. The packer assembly of claim 2, wherein the tapered mating surface is defined by the cover sleeve.

5. The packer assembly of claim 1, wherein the support shoe comprises a ductile material that exhibits a percent elongation ranging between 10% and 100%.

6. The packer assembly of claim 1, wherein the support shoe comprises a ductile material selected from the group consisting of iron, carbon steel, brass, aluminum, stainless steel, a wire mesh, a para-aramid synthetic fiber, a thermoplastic, any alloy thereof, and any combination thereof.

7. The packer assembly of claim 1, wherein the lever arm has a bottom surface that extends at a first angle from horizontal and the fulcrum section extends from the jogged leg at a second angle, the second angle being equal to or greater than the first angle.

8. The packer assembly of claim 7, wherein the first angle ranges between 5° and 45° from horizontal and the second angle ranges between 45° and 75°.

9. A support shoe for a sealing element of a packer assembly, comprising:

an annular body made of a ductile material and providing a jogged leg, a lever arm, and a fulcrum section that extends between and connects the jogged leg to the lever arm, wherein the jogged leg is sized to be received within a gap defined between a cover sleeve and a shoulder of the packing assembly, wherein the lever arm extends at an angle to extend axially over a portion of the sealing element, wherein the jogged leg and the lever arm are plastically deformable when the sealing element moves to a fully set position, and wherein a casing and the lever arm form a metal-to-metal seal at an interface between the casing and the lever arm.

10. The support shoe of claim 9, wherein a tapered mating surface provided in the gap plastically deforms the jogged leg and generates a seal within the gap upon moving the sealing element to the folly set position.

11. The support shoe of claim 9, wherein the ductile material exhibits a percent elongation ranging between 10% and 100'%.

12. The support shoe of claim 9, wherein the ductile material is selected from the group consisting of iron, carbon steel, brass, aluminum, stainless steel, a wire mesh, a para-aramid synthetic fiber, a thermoplastic, any alloy thereof, and any combination thereof.

13. The support shoe of claim 9 wherein the lever arm has a bottom surface that extends at a first angle from horizontal and the fulcrum section extends from the jogged leg at a second angle, the second angle being equal to or greater than the first angle.

14. The support shoe of claim 13, wherein the first angle ranges between 5° and 45° from horizontal and the second angle ranges between 45° and 75°.

15. A spacer for a sealing element of a packer assembly comprising:

an annular body made of a rigid or semi-rigid material, wherein the annular body defines an inverse airfoil design;

an upper end, wherein the upper end provides an upper angled surface adapted to engage an upper sealing element;

a lower end, wherein the lower end provides a lower angled surface adapted to engage a lower sealing element; and a recessed portion that extends between the upper end and the lower end, wherein the recessed portion faces radially outward toward an inner wall of a casing.

16. The spacer of claim 15, wherein the upper end and the lower end exhibit a first diameter and the recessed portion exhibits a second diameter that is smaller than the first diameter.

17. The spacer of claim 15, wherein the upper end and the lower end transition to the recessed portion via a tapered surface that extends at an angle from horizontal.

18. The spacer of claim 15, wherein the upper angled surface and the lower angled surface exhibit an angle ranging from about 25° to about 75° from horizontal.

19. The spacer of claim 15, wherein the annular body provides one or more equalization ports that extend radially through the body to fluidly communicate with a dead space.

20. The spacer of claim 19, wherein the dead space is at least partially defined by an annular groove in the bottom of the annular body.

* * * * *